United States Patent [19]

Montanarello

[11] 4,120,500

[45] Oct. 17, 1978

[54] LIGHT IMAGE TARGET WITH ELEVATING AND ROTATING PROJECTOR

[76] Inventor: Benedict Montanarello, 35 Odell Ave., Apt. 2C, Yonkers, N.Y. 10701

[21] Appl. No.: 756,870

[22] Filed: Jan. 5, 1977

[51] Int. Cl.[2] ..... A63B 65/02; F41B 7/08

[52] U.S. Cl. ..... 273/101; 273/105.1; 124/29

[58] Field of Search ..... 273/105.1, 101, 101.1, 273/101.2, 85 A; 124/29; 89/37 B, 37 BA, 37 D, 37 F, 37 A; 42/94

[56] References Cited

U.S. PATENT DOCUMENTS

| | | | |
|---|---|---|---|
| 1,249,778 | 12/1917 | Krupka | 89/37 B |
| 1,444,768 | 2/1923 | Wright | 89/37 B |
| 1,813,985 | 7/1931 | Blackmore | 124/29 |
| 1,841,262 | 1/1932 | Wallace | 273/105.1 |
| 2,888,004 | 5/1959 | Steiner | 124/27 |
| 3,748,751 | 7/1973 | Breglia et al. | 273/101.1 |
| 3,990,704 | 11/1976 | Meyer et al. | 273/105.1 |

FOREIGN PATENT DOCUMENTS

| | | | |
|---|---|---|---|
| 524,152 | 4/1955 | Italy | 273/85 A |

*Primary Examiner*—Richard C. Pinkham
*Assistant Examiner*—Lawrence E. Anderson

[57] ABSTRACT

Space flight game apparatus is disclosed comprising a projector for casting a light image on a planar surface, the projector being used in combination with projectile launching members. The light image may be moved on the planar surface and the projectile launching members are controlled so that the height and angle of the planar surface may be changed as the light image is moved on the planar surface.

2 Claims, 4 Drawing Figures

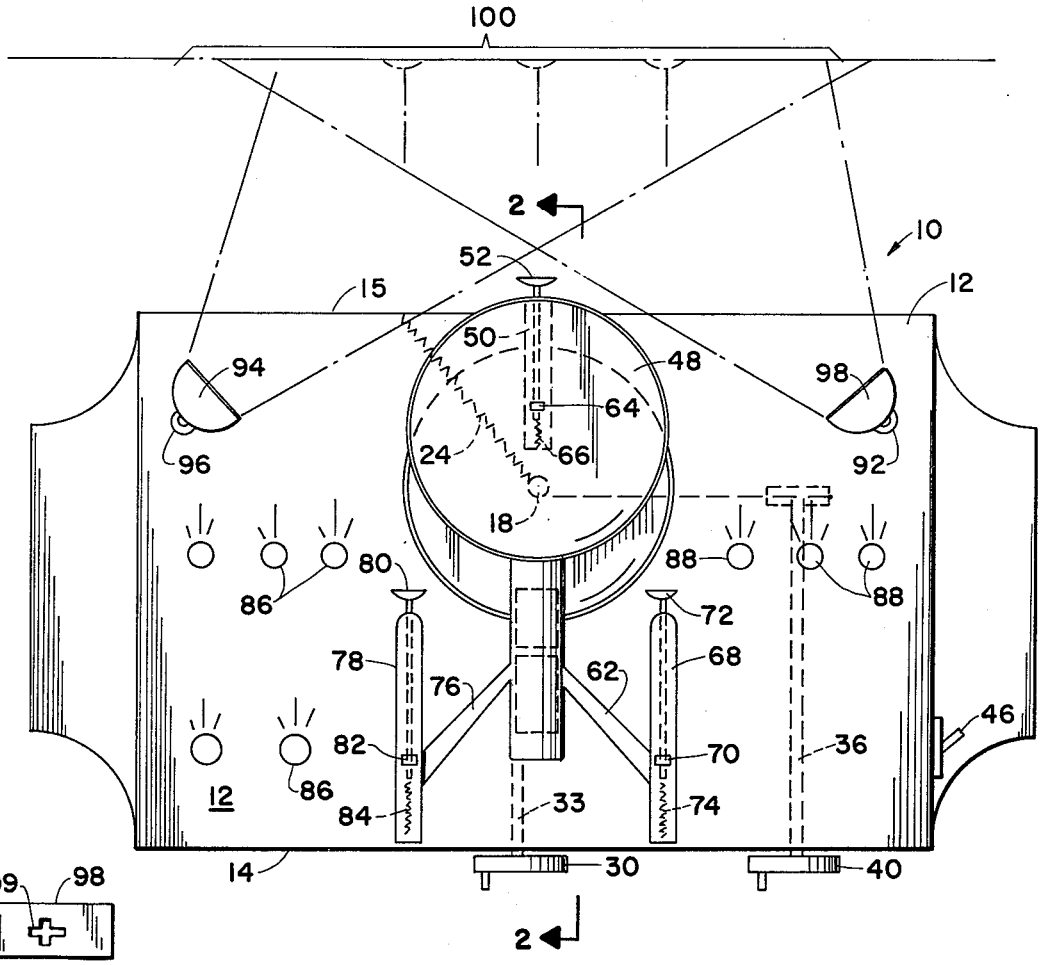
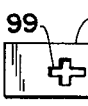
FIG. 4
FIG. 1
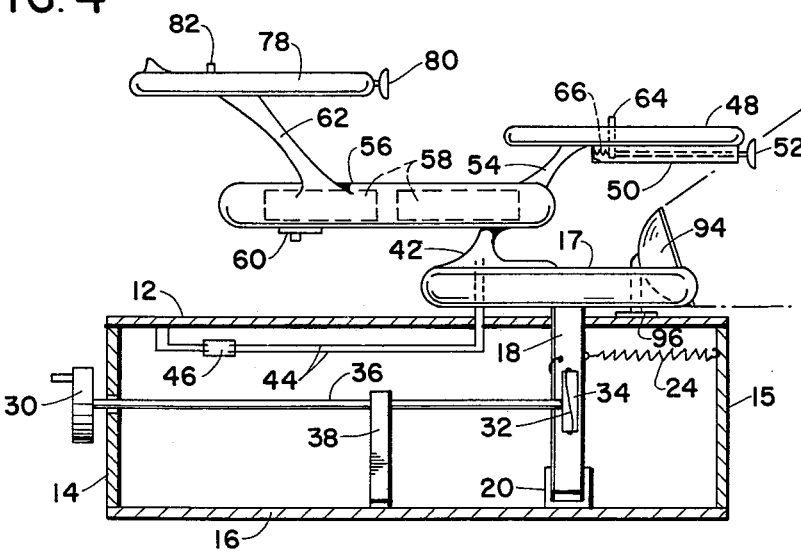
FIG. 2
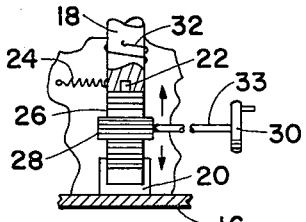
FIG. 3

LIGHT IMAGE TARGET WITH ELEVATING AND ROTATING PROJECTOR

SUMMARY OF THE INVENTION

The present invention relates to a space flight game apparatus comprising a variable projection member for casting a light image in any one of a plurality of positions on a planar surface. A projectile launching member is mounted on the platform extending from the base, the platform being rotatable about a pivot extending from the base. The platform is rotated through a turning member operatively associated with the platform. The platform is raised and lowered through an elevator member, the turning member and the elevator member being arranged so that the projectile launching member can be aligned to fire a projectile at a light image cast by the projection member at any of a plurality of positions on the planar surface.

The variable projection member may comprise a light source in combination with indicia, the indicia being positioned in between the light source and a planar surface. The light source and image are pivotally mounted for casting the light image at any one of a plurality of positions on the planar surface.

The projectile launching member may comprise at least one launching tube having a propelling member operatively associated therewith. The propelling member is arranged to deliver an accelerating force to a projectile. A trigger member is provided for releasing the accelerating force from the propelling member.

The turning member may comprise a first crank member associated with the platform for rotating the platform substantially on a horizontal plane. The elevator member may comprise a second crank member operatively associated with the platform for raising and lowering the platform.

The first crank member may comprise a rotatable wheel having a cord associated therewith at one end. The pivot about which the platform is rotatable comprises an axle substantially transverse to the platform. The other end of th- cord is wound around and secured to the axle. A resilient member is operatively associated with the platform for applying a return torque to the platform when the platform is rotated. This arrangement allows for the rotation of the wheel which causes the axle and the platform in turn to rotate.

The pivot about which the platform is rotatable is also employed in combination with the second crank member, the latter comprising a rack the longitudinal axis of which is coincident with the longitudinal axis of the axle. The axle is rotatably mounted on the rack in combination with a pinion which rotatably engages the rack whereby rotation of the pinion causes the axle to extend and retract relative to the pinion.

BRIEF DESCRIPTION OF THE SEVERAL VIEWS OF THE DRAWING

FIG. 1 comprises a plan view partially in section of a space flight game apparatus according to one embodiment of the present invention;

FIG. 2 comprises a side elevation in section taken along the line 2—2 of FIG. 1;

FIG. 3 comprises a partial front elevation partially in section of elevator apparatus for raising and lowering a projectile launching member for space flight game apparatus according to another embodiment of the present invention; and FIG. 4 comprises a plan view of a silhouette card employed for casting a light image which is employed as a target in a space flight game apparatus having projectile launching members according to another embodiment of the present invention.

DETAILED DESCRIPTION

Space flight game apparatus and projectile game apparatus are disclosed in the prior art U.S. Pat. Nos. to Ferrer 3,610,623; Kymla, et al. 3,495,828; Robertson 3,392,981; Pearson, Jr. 3,010,718; Bradstreet 2,935,316; Steiner 2,888,004; Hamilton 2,382,146 and Alston 2,684,243.

It is an object of the present invention to provide novel space flight game apparatus.

It is a further object of the present invention to provide novel space flight game apparatus comprising a projector which is able to cast a moving light image or a fixed light image against a planar surface and which has projectile launching members for firing projectiles at the light image.

It is also an object of the present invention to provide such space flight game apparatus in which the projectile launchers may be adjusted for the changing position of the light image and aimed thereat.

These and other objects have been achieved according to the present invention and will become apparent by reference to the disclosure and claims that follow as well as the appended drawing.

Referring to the drawing and FIGS. 1–4 therein, space flight game apparatus 10 is illustrated comprising a base consisting of a top wall 12, side walls 14 and 15 and a bottom wall 16 to form an enclosure. A platform 17 is rotatably mounted on the bottom wall 16 through an opening in the top wall 12 by means of an axle 18 extending down into a cup shaped member 20 for receiving the bottom extension 26 of the axle 18. The bottom portion of axle 18 is positioned on a rack 26 through means of a pin 22 so that the axle 18 may rotate on the pin 22. The rack 26 is moved upwardly and downwardly relative to the pinion 28 by means of a shaft 33 operatively connected to a wheel 30. Rotation of the pinion 28 in either direction will cause the rack 26 to move upwardly or downwardly with respect to the cup 20. The platform 17 is rotated about axle 18 by means of a wheel 34 operatively connected to a crank 40 through shaft 36, the latter being rotatably mounted on a support 38. A line or piece of cord 32 is windable about the wheel 34, one end of cord 32 being secured to the wheel 34, the other end of cord 32 being secured to axle 18. A resilient member such as coil spring 24 is secured at one end thereof to axle 18 and at the other end thereof to the side wall 15, the spring 24 being arranged to apply a return torque to the axle 18 once it is rotated by means of string 32 in combination with wheel 34. A tube 56 is secured to platform 17 by means of a pylon 42, tube 56 having a pair of batteries 58 which are connected to lights 98 and 94 through wires and a switch 60. Lights 90 and 94 in turn are pivotally mounted on universal joints 92 and 96, respectively, extending from the top wall 12. Lights 86 and 88 are also connected to the batteries 58 by means of electrical wires 44 and a switch 46. Pylon 62 and 76 extend outwardly from the tube 56. Pylon 62 has a projectile launching tube 68 extending therefrom such as a tube for launching a dart 72 by means of a spring 74 and a trigger 70, the mechanism of which is well known in the art. Tube 78 is similarly mounted on pylon 76 and has dart 80 mounted therein which may be launched by means of a spring 84 and trigger mechanism 82. A disc 48 is secured to the tube 56 through a pylon 54, disc 48 having a tube 50 thereon for launching a dart 52 by means of a spring 66 and trigger release mechanism 64. Indicia such as a silhouette card 98 having a slot opening 99 therein for projecting an image on a planar surface such as a black screen 100 is provided as illustrated in FIG. 4, silhouette card 98 being positionable in front of the light source 90 or 94.

In one embodiment, it is preferred that the lights 86 and 88 comprise red lights and can be employed as "red alert" lights to signal one of the competing players operating the trigger mechanisms of the projectile launching apparatus that the time in which projectiles can be launched has been initiated.

In use, indicia is projected onto the screen 100 through the silhouette card 98 positioned in front of either of the lamps 90 and 94 and preferably secured thereto. The indicia thus projected on the screen 100 may be fixed or moving, the moving indicia comprising a moving target which entails a greater degree of difficulty in hitting with the projectiles launched from any of the projectile tubes 68, 78 and 50. The image from the silhouette card 98 is then projected onto the screen 100 by turning on the lights through switch 60 and the image is projected. The platform 17 is moved into position by the manipulation of the handles 40 or 30, the turning of handle 40 causing the platform and the various projectile launchers extending therefrom to rotate in a plane parallel to the top wall 12 whereas the manipulation of the handle 30 causes the rack and pinion to engage the bottom of the axle 18 so that the proper elevation of the projectile launching tubes can be attained and the various projectiles such as cup tipped darts 80, 72 and 52 are launched. Upon the throwing of the switch 46, the red alert lights 86 and 88 will be flashed on at which time the player operating the trigger mechanism 70, 82 and 64 as well as the crank handles 30 and 40 may proceed to line up the missiles 72, 80 and 52 with the target or image projected on the screen 100. The competitor performing these operations has a pre-arranged set time in which to launch all missiles in an attempt to put one of the missiles on to the image projected by the lamps 90 and/or 94.

Various points can be scored based on the number of hits or combination of hits and certan minimum time spans. The player to score the most points wins the game.

Although the invention has been described by reference to some embodiments, it is not intended that the novel space flight game apparatus be limited thereby but that modifications are intended to be included as falling within the broad spirit and scope of the foregoing disclosure, the following claims and the appended drawing.

What is claimed is:

1. Space flight game apparatus comprising a light source in combination with indicia, said indicia being positioned in between said light source and a planar surface, said light source and indicia being pivotally mounted for casting said light image at any one of a plurality of positions on a planar surface, at least one launching tube mounted on a platform extending from a base having propelling means operatively associated therewith, said propelling means arranged to deliver an accelerating force to a projectile, trigger means for releasing an accelerating force from said propelling means, said platform being rotatable in a horizontal plane about a pivot extending therefrom, said platform being rotated through a rotatable wheel operatively associated with said platform, said rotatable wheel having a cord secured thereto at one end, said pivot about which said platform is rotatable comprising an axle substantially transverse to said platform, the other end of said cord being wound around and secured to said axle, resilient means operatively associated with said platform for applying a return torque to said platform when said platform is rotated, whereby rotation of said wheel causes said axle and platform to rotate, said platform being raised and lowered through crank means operatively associated with said platform for raising and lowering said platform, said rotatable wheel and said crank means being arranged so that said launching tube can be aligned to fire a projectile at a light image cast by said light source in combination with indicia at any of said plurality of positions on a planar surface.

2. The apparatus of claim 6 where said pivot about which said platform is rotatable comprises an axle substantially transverse to said platform, said crank means comprises a rack, the longitudinal axis of which is coincident with the longitudinal axis of said axle, said axle being rotatably mounted on said rack, a pinion rotatably engaging said rack whereby rotation of said pinion causes said axle to extend and retract relative to said pinion.

* * * * *